US006062758A

United States Patent [19]

Maurer et al.

[11] Patent Number: 6,062,758

[45] Date of Patent: May 16, 2000

[54] INK WRITING IMPLEMENT

[75] Inventors: Petra Maurer, Hamburg; Bernd Bastiansen, Wedel, both of Germany

[73] Assignee: Rotring International GmbH & Co. KG, Hamburg, Germany

[21] Appl. No.: 09/077,012

[22] PCT Filed: Apr. 1, 1997

[86] PCT No.: PCT/EP97/01597

§ 371 Date: May 18, 1998

§ 102(e) Date: May 18, 1998

[87] PCT Pub. No.: WO97/37860

PCT Pub. Date: Oct. 16, 1997

[30] Foreign Application Priority Data

Apr. 4, 1996 [DE] Germany ..... 196 14 784

[51] Int. Cl.[7] ..... B40K 5/00

[52] U.S. Cl. ..... 401/199; 401/227; 401/209

[58] Field of Search ..... 401/199, 209, 401/227, 228, 229

[56] References Cited

U.S. PATENT DOCUMENTS

| | | | |
|---|---|---|---|
| 3,411,854 | 11/1968 | Rösler et al. | 401/227 |
| 4,556,336 | 12/1985 | Sano et al. | 401/199 |
| 4,671,692 | 6/1987 | Inaba | 401/199 |

FOREIGN PATENT DOCUMENTS

| | | | |
|---|---|---|---|
| 2 569 615 | 3/1986 | France . | |
| 2 685 252 | 6/1993 | France | 401/209 |
| 2685252 | 6/1993 | France | 401/209 |
| 1 461 628 | 3/1969 | Germany . | |
| 0151 561 | 10/1981 | Germany . | |
| 3309111 | 9/1983 | Germany . | |
| 3429031 | 2/1986 | Germany . | |
| 183403 | 5/1992 | Taiwan . | |
| 225204 | 6/1994 | Taiwan . | |
| WO 94/08798 | 4/1994 | WIPO . | |

*Primary Examiner*—David J. Walczak

*Attorney, Agent, or Firm*—Marshall, O'Toole, Gerstein, Murray, & Borun

[57] ABSTRACT

An ink writing implement having a writing tip, an ink reservoir and a housing component enclosing the ink reservoir, includes a molded, ink delivery unit having a plurality of disc-shaped walls, a plurality of ring-shaped pressure compensation chambers, a flat area, an ink feed channel formed by the flat area, and a parting plane extending through the flat area.

10 Claims, 3 Drawing Sheets

INK WRITING IMPLEMENT

The invention relates to an ink writing implement and, more specifically, to an ink delivery unit of an ink writing implement.

Such ink writing implements are generally known (for example DE-A-1 461 628, DD-A-0 151 561). The ink delivery units of the prior art include annular pressure-compensation chambers with capillary dimensions, and are manufactured using the injection-moulding method in a die mold including first and second mold halves, wherein stacks of sheet-metal plates comprising thin-walled sheet-metal laminates, which may be of a thickness of, for example 0.10 mm to 1.0 mm, are secured half. In addition, the stack of sheet-metal plates of one of the die mold halves is provided with an axially extending longitudinal sheet-metal plate which is provided in the circumferential region and by means of which the axially extending, capillary ink-feed channel is produced, for example in the form of a flat area (DE-A-3 429 031), in the molded element to be manufactured, and out of which longitudinal sheet-metal plate ink enters the annular pressure-compensation chamber during operation if an overpressure arises in the interior of the ink writing implement.

In order to form pressure-compensation chambers of essentially constant width which are continuous over their entire circumference by means of the die molded so that a large volume for holding excess ink is retained, it is necessary for the individual sheet-metal plates of the stacks of sheet-metal plates of the two molded halves to lie flush one on top of the other when the molded is closed and not to be offset axially with respect to one another. Only when there is flush alignment is a situation brought about in which an annular pressure-compensation chamber forms a continuous connection of essentially constant dimensions from one side of the ink-feed channel around the circumference of the molded, ink delivery unit to the other side of the ink-feed channel. However, such a flush alignment can only be obtained with a large degree of effort owing to the large number of extremely thin-walled sheet-metal plates of the stacks of sheet-metal plates. Normally, a certain axial offset is always produced, so that the respectively associated sheet-metal plates of the two mold halves are somewhat offset axially with respect to one another when the die mold is closed in the mould parting plane. As a result, a constriction or even interruption in annular pressure-compensation chambers, and thus a reduction in the chamber volume in the molded, ink delivery unit, occur in the region of the parting plane in the molded, ink delivery unit, at any rate the function is influenced.

It is also already known (WO 95/08798) to compose the molded, ink delivery unit of an ink writing implement from two separately manufactured units, the parting plane of the two units extending through the ink-feed channel, half of which is formed by one of the subelements and the other half of which is formed by the other subelement.

The object of the invention is to improve a writing implement to the effect that a situation is brought about in which, without appreciable production outlay, the annular pressure-compensation chambers of the molded, ink delivery unit are of a constant width over virtually their entire circumference.

In order to achieve this object, a writing implement is designed according to the invention in such a way that the molded, ink delivery unit has an axially extending flat area in order to form the ink-feed channel, and the mold parting plane passes through this flat area.

In a deviation from the known design of the molded, ink delivery unit of the writing implement, in the writing implement the mold parting plane is not offset by 90° with respect to the radii through the center of the ink-feed channel but rather in the plane of such radii, the ink-feed channel being formed by a flat area of the molded, ink delivery unit. Forming the ink-feed channel by means of a flat area makes it possible to form radially inwardly protruding regions in the mold halves, which regions correspond to the die mold, bear one against the other when the die mold is closed and do not prevent the die mould being opened in order to reject the manufactured ink delivery unit after the injection molding method has been carried out. The annular pressure-compensation chambers are formed by sheet-metal plates of stacks of sheet-metal plates in the mold halves, said plates extending in each case from the one side of the flat area to the side of the molded, ink delivery unit lying diametrically opposite the flat area, so that the sheet-metal plates of the two mold halves abut at this side lying opposite. If, in the process, a certain axial offset arises between the sheet-metal plates, this does not reduce the holding capacity of the annular pressure-compensation chambers, even if they are not connected to one another at all on the side lying opposite the flat area. Since each mold half forms a half of such a pressure-compensation chamber and each of these halves is connected to the flat area forming the ink-feed channel, a connection is produced between the entire pressure-compensation chamber and the ink-feed channel, without a possible interruption in the course of the pressure-equalization chamber on the side lying opposite the ink-feed channel leading to a reduction in volume.

The flat area can lie in the region of a dividing wall, which is formed in the moulded element and which interrupts the annular spaces in the circumferential direction, the flat area having a width which is at least equal to the thickness of the dividing wall in its radially outer region, in order to obtain a sufficient connection between the ink-feed channel and the annular pressure-compensation chambers. Preferably, the mold parting plane extends here through the center of the dividing wall and the center of the flat area.

The regions of the disc-shaped walls of the molded, ink delivery unit lying opposite the flat area can be flattened in order to form the air-feed channel. At the same time, the front end of the air-feed channel can end at an annular space, which is connected to the ambient air.

In a particularly preferred exemplary embodiment, the writing tip is formed by a wick element or fluid-feed element which is inserted into an axial through-hole of the molded, ink delivery unit.

The invention is explained in more detail below with reference to figures showing an exemplary embodiment.

Figure 1:
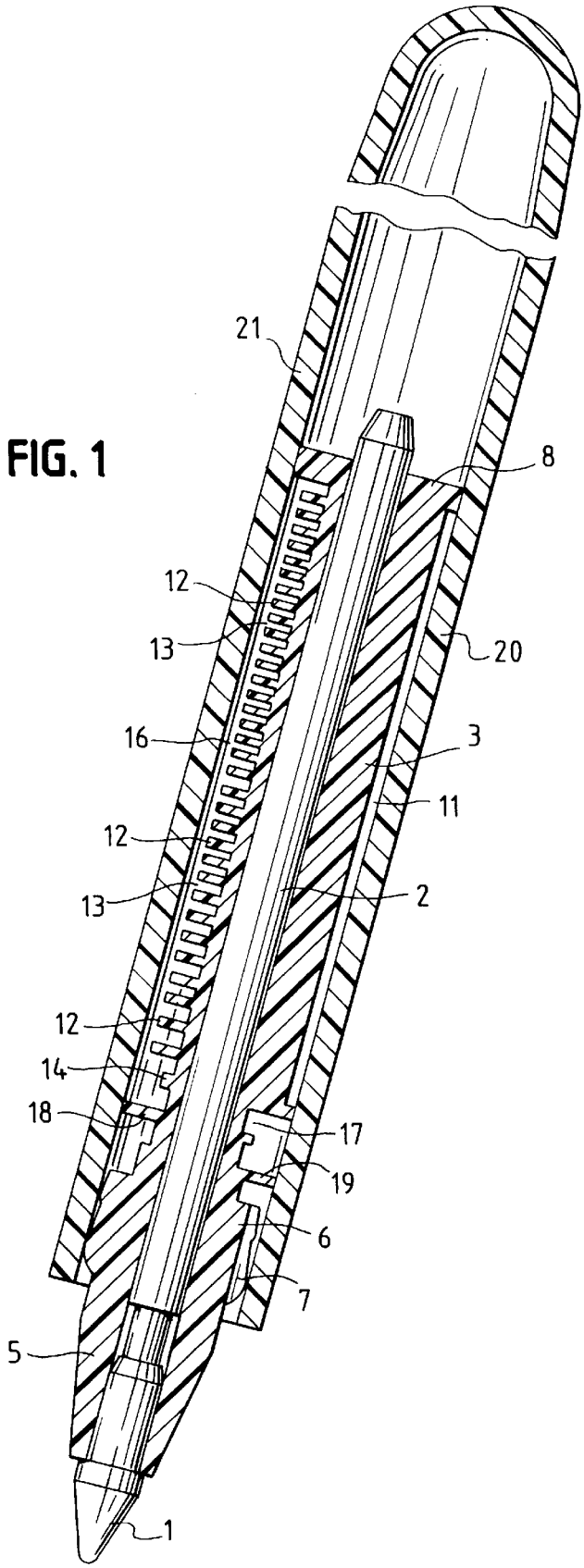
FIG. 1 shows a sectional view of a writing implement according to the invention.
Figure 2:
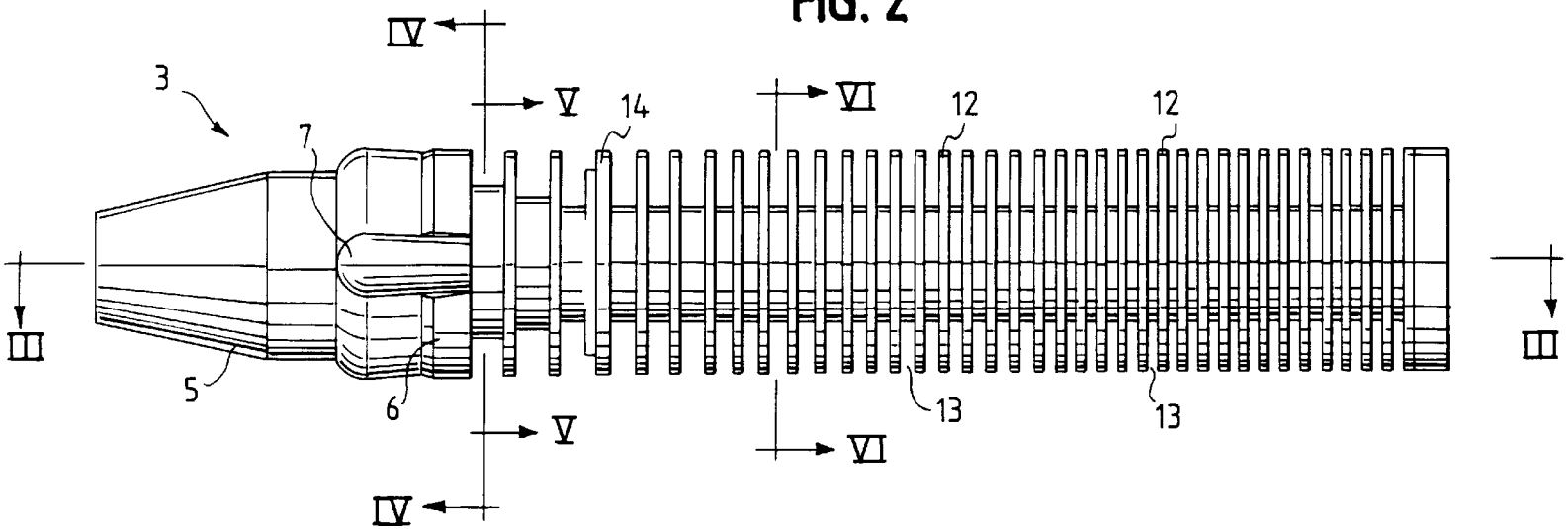
FIG. 2 shows a side view of the molded, ink delivery unit of the writing implement from FIG. 1.
Figure 3:
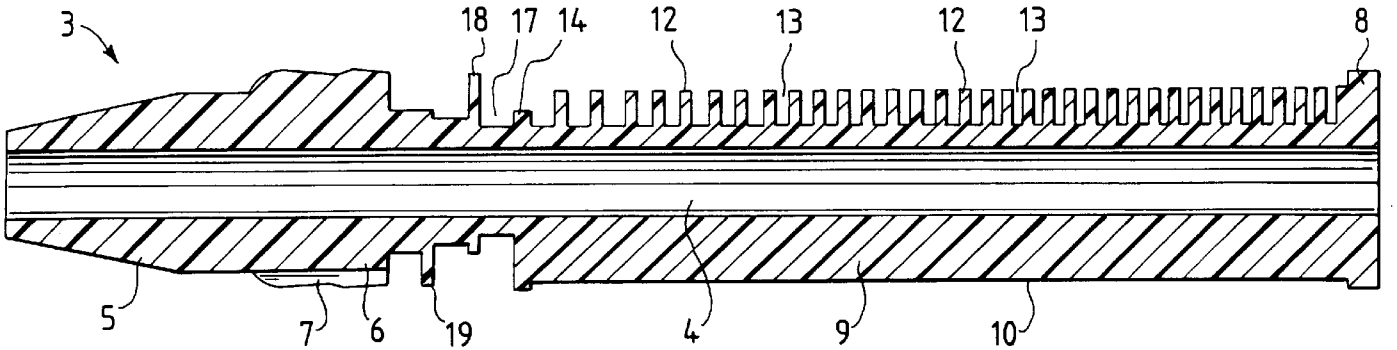
FIG. 3 shows a sectional view along the line III—III from FIG. 2.
Figure 4:
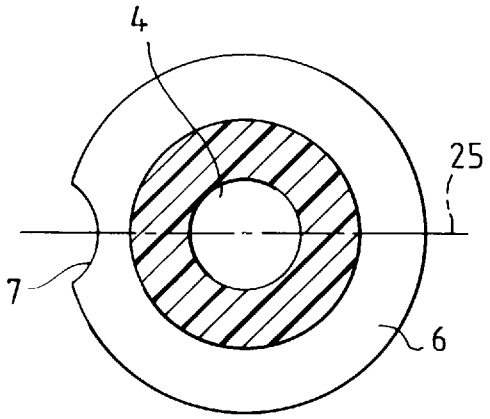
FIG. 4 shows a sectional view along the line IV—IV from FIG. 2.
Figure 5:
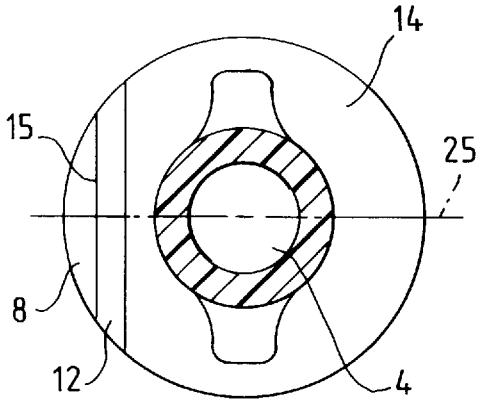
FIG. 5 shows a sectional view along the line V—V from FIG. 2.

The writing implement illustrated has a protruding writing tip 1, which is formed at the front end of a wick or fluid-feed element 2 which is inserted into an axial through-hole 4 of a molded, ink delivery unit 3 to be described later, and protrudes at its rear end. At the front end, the wick or fluid-feed element 2 is held in the front section 5 of the molded, ink delivery unit 3 in a clamping fashion. The molded, ink delivery unit 3 is seated in a holding shaft 20 whose rear closed end, into which the protruding end of the wick or fluid-feed element 2 projects, is filled with free writing fluid, preferably ink, which preferably also contains microcolouring-agent particles. When a wick element 2 is used, this writing fluid passes in a customary way from the rear end to the writing tip 1 through capillary structures formed in the body of said wick element 2, and when a non-porous fluid-feed body 2 is used, said writing fluid is fed to the writing tip 1 via capillary channels formed in the surface of said fluid-feed element 2.

The molded, ink delivery unit 3 has circular ring-shaped pressure-compensation chambers 13 which extend in a customary fashion in the circumferential direction, have capillary dimensions, are bounded by lateral disc-shaped walls 12 and increase in width from the rear to the front, as is also known.

Figure 6:
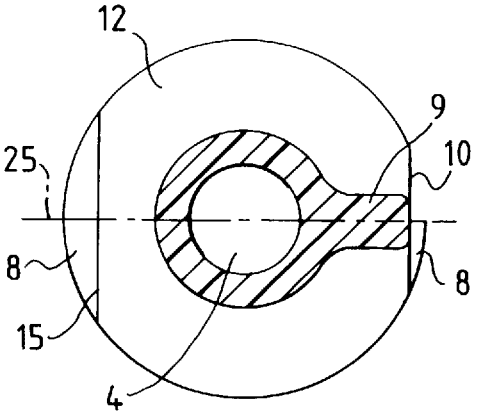
FIG. 6 shows a sectional view along the line VI—VI from FIG. 2.

In the region of the annular pressure-compensation chambers 13, the molded, ink delivery unit 3 wall, which surrounds the axial through-hole 4 in order to hold the wick element or fluid-feed element 2, runs radially outwards, forming an axially extending dividing wall 9, as far as a flat area 10 which is formed on the disc-shaped walls 12, in which case, as can be seen in particular in FIG. 6. The dividing wall 9 and the flat area 10 lie centrally with respect to the plane 25, and the flat area 10 is wider than the dividing wall 9. The flat area 10 forms, together with the enveloping holding shaft 20, a capillary ink-feed channel 11 (FIG. 1), which extends axially from the rear flange 8 of the molded, ink delivery unit to a disc-shaped wall 14, which lies in front of the annular pressure-compensation chambers 13 and may possibly be the front boundary wall of the front pressure-compensation chamber. As is readily apparent, the flat area 10 and/or the ink-feed channel 11 formed by it, together with the holding shaft 20, is connected, specifically on both sides of the dividing wall 9, to all the annular pressure-compensation chambers 13 extending in the circumferential direction. Moreover, the flange 8 is, as indicated in FIG. 6, interrupted over half the width of the flat area 10 to a depth corresponding to the flat area 10 and in the circumferential direction. When the molded, ink delivery unit 3 is inserted into the holding shaft 20, the flange 8 therefore bears with the greatest part of its circumference against the inner face of the holding shaft 20 in a sealing fashion, but forms, in the region of the interruption of the flange 8, a narrow, capillary connection between the writing fluid reservoir 21 and the annular pressure-compensation chambers 13.

On the side of the molded, ink delivery unit 3 lying opposite the flat region 10, there is a flat area 15 on the disc-shaped walls 12. An air-feed channel 16 is formed when the moulded element 3 is inserted into the holding shaft 20, in the section 6 of the moulded element 3 which brings about the front clamping of the moulded element 3 in the holding shaft 20, to the ambient air via an annular space 17, formed between disc-shaped walls 14 and 18, and via a further annular space, interrupted by a disc-shaped dividing wall 9, and an axial groove 7.

A customary pressure-compensation system is formed by the interruption in the rear flange 8 of the moulded element 3, the capillary ink-feed channel 11 with the annular, capillary pressure-compensation chambers 13 connected to said channel 11 and by means of the air-feed channel 16, which is connected to the ambient air. If an increase in pressure is produced in the interior of the writing implement, in particular in the writing fluid reservoir 21, writing fluid is forced through the narrow interruption in the rear flange 8 into the region of the rear annular pressure-compensation chamber and passes from there into the ink-feed channel 11, in which it is moved forwards, filling further annular pressure-compensation chambers 13 in the process, until the equilibrium is restored. If writing fluid is removed, the fluid located in the pressure-compensation chambers 13 is "written with" first.

The connection between the air-feed channel 16 and the ambient air is present in order to ensure that there is continuous pressure compensation when writing fluid in the writing fluid reservoir 21 is consumed, with the result that when a vacuum is produced in the writing fluid reservoir 21, air is sucked into the writing fluid reservoir 21 through the axial groove 7, the annular space 17, the air-feed channel 16 and the interruption in the circumference of the flange 8.

As has been illustrated and explained, the moulded element 3 has a flat area 10 which serves to form the ink-feed channel 11 and which is connected to the annular pressure-compensation chambers 13 on both sides of the dividing wall 9. In order to manufacture this moulded element, a die mold is used, which comprises two mold halves and lies, in the closed state, with its parting plane in the plane 25. As a result, each of the mold halves contains stacks of sheet-metal plates in order to form the annular pressure-compensation chambers 13, which abut in the parting plane 25 and on the side lying diametrically opposite the dividing wall 9. Even if, in the process, an axial offset occurs in the abutting region of the individual halves of the sheet-metal plates, when the molded, ink delivery unit 3 is being injection molded there is, with regard to FIG. 6, a complete half of an annular pressure-compensation chamber 13 formed both above and below the parting plane 25, while, as a result of the axial offset of the sheet-metal plates, the annular pressure-compensation chamber 13 can have a constriction or interruption in the region diametrically opposite the dividing wall 9. However, this does not adversely affect the capacity of the annular pressure-compensation chamber 13, since, again with regard to FIG. 6, this has an unimpeded connection to the ink-feed channel 11 both via the upper section of the flat area 10 and via the lower section of the flat area 10, that is to say writing fluid can enter unimpeded from said ink-feed channel 11 in both circumferential directions.

Figure 7:
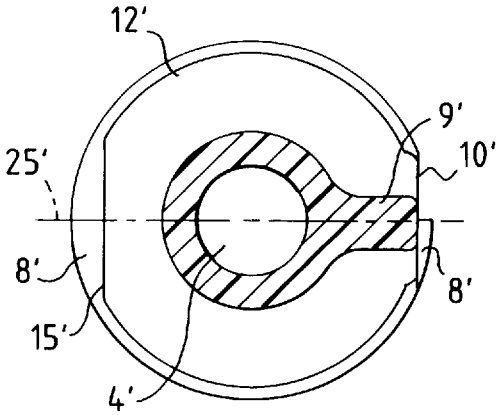
FIG. 7 shows another exemplary embodiment in a view in accordance with FIG. 6.

In the exemplary embodiment according to FIG. 7, parts which are identical or which correspond to one another are designated with identical reference symbols and additionally by'.

Whereas, in the exemplary embodiment in accordance with FIGS. 1 to 6, the disc-shaped walls 12 have, in their circular regions, the same diameter as the circular region of the flange 8 and of the walls 18 and 19, and are therefore in contact with the internal surface of the holding shaft 20. The diameter of the circular regions of the disc-shaped walls 12' is somewhat smaller in the exemplary embodiment in accordance with FIG. 7, so that, in the state of insertion into the holding shaft, they are located at a small distance from its internal surface, where adjacent pressure-compensation chambers are connected to one another in their radially outer regions.

What is claimed is:

1. An ink writing implement having a front end and a rear end including a writing tip provided at the front end, an ink reservoir disposed at the rear end for supplying the writing tip with ink and a housing component enclosing the ink reservoir, comprising:

a molded, ink delivery unit disposed within the housing component between the writing tip and the ink reservoir having a plurality of disc-shaped walls, a plurality of pressure-compensation chambers separated by the disc-shaped walls, a flat area, an ink feed channel formed by the flat area for connecting the ink reservoir to the pressure-compensation chambers and a parting plane extending through the flat area, wherein the position of the parting plane and the flat area ensures constant communication between the ink feed channel and the pressure-compensation chambers.

2. The ink writing implement of claim 1, further comprising, a dividing wall including a radially external region having a thickness, wherein the flat area lies in the region of the dividing wall interrupting the pressure-compensation chambers, and is of a width which is at least equal to the thickness of the radially external region of the dividing wall.

3. The ink writing implement of claim 1, wherein the parting plane extends through the center of the dividing wall and the center of the flat area.

4. The ink writing implement of claim 1 wherein the writing tip is formed by a fluid-feed element which is inserted into an axial through hole of the ink delivery unit.

5. The ink writing implement of claim 1 wherein the writing tip is formed by a wick element which is inserted into an axial through hole of the ink delivery unit.

6. The ink writing implement of claim 1, wherein the pressure-compensation chambers are ring-shaped.

7. The ink writing implement of claim 1, wherein the molded, ink delivery unit is manufactured using an injection molding method in a die mold comprising two mold halves with a plurality of embedded stacks of sheet-metal plates to form the pressure-compensation chambers.

8. The ink writing implement of claim 1, further comprising an air channel for connecting the ink reservoir to the air.

9. The ink writing implement of claim 8, wherein the disc-shaped walls disposed opposite the flat area are flattened in order to form the air-feed channel.

10. The ink writing implement of claim 8, characterized in that the wherein the air channel comprises a front end that ends at an annular space connected to the ambient air.

* * * * *